US007450096B2

(12) United States Patent
Kwon

(10) Patent No.: US 7,450,096 B2
(45) Date of Patent: Nov. 11, 2008

(54) METHOD AND APPARATUS FOR DRIVING LIQUID CRYSTAL DISPLAY DEVICE

(75) Inventor: Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 727 days.

(21) Appl. No.: 11/017,775

(22) Filed: Dec. 22, 2004

(65) Prior Publication Data

US 2005/0156852 A1 Jul. 21, 2005

(30) Foreign Application Priority Data

Dec. 27, 2003 (KR) ..... 10-2003-0098100

(51) Int. Cl.
*G09G 3/36* (2006.01)

(52) U.S. Cl. ..... 345/87; 345/98; 345/100; 345/208; 345/209; 345/210

(58) Field of Classification Search ..... 345/87, 345/98, 100, 208–210
See application file for complete search history.

(56) References Cited

U.S. PATENT DOCUMENTS

| | | | | |
|---|---|---|---|---|
| 5,495,265 | A | 2/1996 | Hartman et al. | |
| 7,142,183 | B2 * | 11/2006 | Lee | 345/87 |
| 7,202,882 | B2 * | 4/2007 | Morita | 345/698 |

FOREIGN PATENT DOCUMENTS

| | | |
|---|---|---|
| CN | 1398115 | 2/2003 |
| CN | 1459774 | 12/2003 |
| WO | WO 99/05567 | 2/1999 |

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

A method of driving a liquid crystal display device includes compressing a current frame data, storing the compressed current frame data in a frame memory, outputting a compressed data of a previous frame from the frame memory, restoring the compressed data of the previous frame, and comparing the restored data of the previous frame with the current frame data, and modulating the current frame data into a predetermined modulated data based on the comparison result.

11 Claims, 9 Drawing Sheets

FIG. 7

| | | | |
|---|---|---|---|
| YUV | YUV | YUV | YUV |
| YUV | YUV | YUV | YUV |

FIG. 8

| | | | |
|---|---|---|---|
| A | A | B | A |
| A | B | B | B |

FIG. 9

| | | | |
|---|---|---|---|
| 1 | 1 | 0 | 1 |
| 1 | 0 | 0 | 0 |

METHOD AND APPARATUS FOR DRIVING LIQUID CRYSTAL DISPLAY DEVICE

The present application claims the benefit of Korean Patent Application No. P2003-98100 filed in Korea on Dec. 27, 2003, which is hereby incorporated by reference.

BACKGROUND OF THE INVENTION

1. Field of the Invention

The present invention relates to a liquid crystal display device, and, more particularly, to a method and an apparatus for driving a liquid crystal display device that reduce the number of frame memories.

2. Discussion of the Related Art

In general, a liquid crystal display (LCD) device controls light transmittance of liquid crystal cells in accordance with data signals applied thereto, to thereby display an image. In particular, an active matrix type LCD device includes a switching device for each cell and has various applications, such as a monitor for a computer, office equipment, and a cellular phone, because of their high quality image, lightness, thin thickness, compact size, and low power consumption. A thin film transistor (TFT) is generally employed as the switching device for the active matrix type LCD device.

As can be seen from the following Formulas 1 and 2, the liquid crystal display device has a disadvantage that its response time is slow due to its properties, such as the unique viscosity and elasticity of a liquid crystal material.

$$\tau_r \propto \frac{\gamma d^2}{\Delta\varepsilon \,|\, V_a^2 - V_F^2 \,|} \qquad \text{Formula 1}$$

In particular, $\tau_r$ represents a rising time when a voltage is applied to the liquid crystal material; $V_a$ represents an applied voltage; $V_F$ represents a Frederick transition voltage by which liquid crystal molecules begin to make a tilt motion; d represents a cell gap of the liquid crystal cell; and $\gamma$ represents a rotational viscosity of the liquid crystal molecules.

$$\tau_f \propto \frac{\gamma d^2}{K} \qquad \text{Formula 2}$$

In addition, $\tau_f$ represents a falling time at which liquid crystal material is restored to its initial position by an elastic restoration force after the voltage applied to the liquid crystal material was turned off; and K represents a unique elastic coefficient of the liquid crystal material.

A response speed of the liquid crystal material in a twisted nematic (TN) mode, which is a liquid crystal mode having been most widely used in the liquid crystal display device up to now, can be differentiated in accordance with the physical properties and the cell gap of the liquid crystal material, but generally its rising time is about 20 ms~80 ms and its falling time is about 20 ms~30 ms. The response speed of such a liquid crystal material is longer than one frame interval (e.g., 16.67 ms in the case of the NTSC system). For this reason, a voltage charged in the liquid crystal cell is progressed into the next frame before it arrives at a desired voltage as shown in FIG. 1, thereby causing a motion-blurring phenomenon in which the screen gets blurred in the moving picture.

FIG. 1 is a waveform illustrating a change of brightness according to a data in a liquid crystal display device according to the related art. In FIG. 1, when a data VD is changed from one level to another level, a display brightness BL corresponding to such a level change fails to reach a desired brightness and hence fails to express desired color and brightness. As a result, the liquid crystal display device has a motion-blurring phenomenon appearing in the moving picture, and has a poor picture quality due to a deterioration of contrast ratio.

In order to resolve the slow response speed of the liquid crystal display device, U.S. Pat. No. 5,495,265 and PCT international publication No. WO 99/05567 have introduced a scheme of modulating a data depending upon whether or not the data is changed by using a look-up table (hereinafter referred to as "high-speed driving method"), as shown in FIG. 2.

FIG. 2 is a waveform illustrating an example of the change of brightness according to a data modulation in a high-speed driving system according to the related art. In FIG. 2, the high-speed driving method modulates an input data VD to generate a predetermined modulated data MVD and applies the modulated data MVD to a liquid crystal cell, thereby obtaining a desired brightness MBL. The high-speed driving method enlarges a value of $|V_a^2 - V_F^2|$ in Formula 1 on the basis of a change of the data so that it can obtain a desired brightness MBL in correspondence with a brightness value of the input data VD within one frame interval. In particular, a data at the previous frame is compared with a data at the current frame. If a change between the data exists, the data at the current frame is modulated to a predetermined modulated data. Accordingly, the liquid crystal display device adopting the high-speed driving method compensates a slow response speed of the liquid crystal material, to thereby alleviate the motion-blurring phenomenon in the moving picture.

FIG. 3 is a block diagram illustrating an example of a high-speed driving apparatus according to the related art. In FIG. 3, the high-speed driving apparatus includes first and second frame memories 43*a* and 43*b* for storing data DataIn supplied from a data bus 42, and a modulator 44 for modulating the data. The first and the second frame memories 43*a* and 43*b* alternately store data for each frame unit in accordance with a pixel clock and then alternately output the stored data to supply a previous frame data, i.e., the (n−1)th frame data Fn−1 to the modulator 44.

The modulator 44 compares an nth frame data Fn from the data bus 42 with an (n−1)th frame data Fn−1 from the first and second frame memories 43*a* and 43*b*, and then selects a modulated data MRGB corresponding to the compared result from a look-up table. The look-up table may be as shown in Table 1 to modulate the data and is stored in a read only memory (ROM).

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In Table 1, the leftmost column represents the data at the previous frame Fn−1 and the uppermost row represents the data at the current frame Fn.

During the nth frame interval, as indicated by a solid line in FIG. 3, the nth frame data Fn is stored in the first frame memory 43*a* in accordance with the same pixel clock and, simultaneously, is supplied to the modulator 44. In addition, during the nth frame interval, the second frame memory 43*b* supplies the (n−1)th frame data Fn−1 to the modulator 44.

Then, during the (n+1)th frame interval, as indicated by a dotted line in FIG. 3, the (n+1)th frame data Fn+1 is stored in the second frame memory 43*b* in accordance with the same pixel clock and, simultaneously, is supplied to the modulator 44. In addition, during the (n+1)th frame period, the first frame memory 43*b* supplies the nth frame data Fn to the modulator 44.

As described above, the high-speed driving apparatus requires two frame memories 43*a* and 43*b* in order to alternately supply the previous frame data to the modulator 44. Since the frame memories increase fabrication costs, it is necessary to provide a scheme capable of reducing the number of the frame memories or a capacity of the memory.

SUMMARY OF THE INVENTION

Accordingly, the present invention is directed to a method and an apparatus for driving a liquid crystal display device that substantially obviate one or more of the problems due to limitations and disadvantages of the related art.

An object of the present invention is to provide a method and an apparatus for driving a liquid crystal display device that reduce the number of frame memories.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a method of driving a liquid crystal display device includes compressing a current frame data, storing the compressed current frame data in a frame memory, outputting a compressed data of a previous frame from the frame memory, restoring the compressed data of the previous frame, and comparing the restored data of the previous frame with the current frame data, and modulating the current frame data into a predetermined modulated data based on the comparison result.

In another aspect, method of driving a liquid crystal display device includes the steps of: compressing a current frame data inputted via a 2k-bit data input bus into j-bit data, k being an integer and j being an integer smaller than 2k, storing the j-bit compressed current frame data in a frame memory via a j-bit data input bus, outputting a compressed data having been stored in the frame memory at a previous frame via a j-bit data output bus, restoring the compressed data of the previous frame to output them via a 2k-bit data output bus, comparing the restored data of the previous frame inputted via the 2k-bit data output bus with the current frame data inputted via the 2k-bit data input bus, and modulating the current frame data into a predetermined modulated data based on the comparison result.

In yet another aspect, a driving apparatus for a liquid crystal display device includes a compressor for compressing a current frame data, a frame memory for storing the compressed current frame data and outputting a compressed data having been stored at a previous frame, a restorer for restoring the compressed data of the previous frame, and a modulator for comparing the restored data of the previous frame with the current frame data and for modulating the current frame data into a predetermined modulated data based on the comparison result.

In another aspect, a driving apparatus for a liquid crystal display device includes a compressor for compressing a current frame data inputted via a 2k-bit data input bus into j-bit data, k being an integer and j being an integer smaller than 2k, a frame memory for receiving the j-bit compressed current frame data via a j-bit data input bus to store them and for outputting a compressed data having been stored at the previous frame via a j-bit data output bus, a restorer for restoring the compressed data of the previous frame to output them via a 2k-bit data output bus, and a modulator for comparing the restored data of the previous frame inputted via the 2k-bit data output bus with the current frame data inputted via the 2k-bit data input bus and for modulating the current frame data into a predetermined modulated data based on the comparison result.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 7 depicts an example of 4×2 data blocks outputted from the YUV calculator shown in FIG. 6; and FIG. 8 and FIG. 9 are views for explaining an compression principle of the compressor shown in FIG. 6.

DETAILED DESCRIPTION OF THE PREFERRED EMBODIMENTS

Reference will now be made in detail to the preferred embodiments, examples of which are illustrated in the accompanying drawings.

Figure 1:
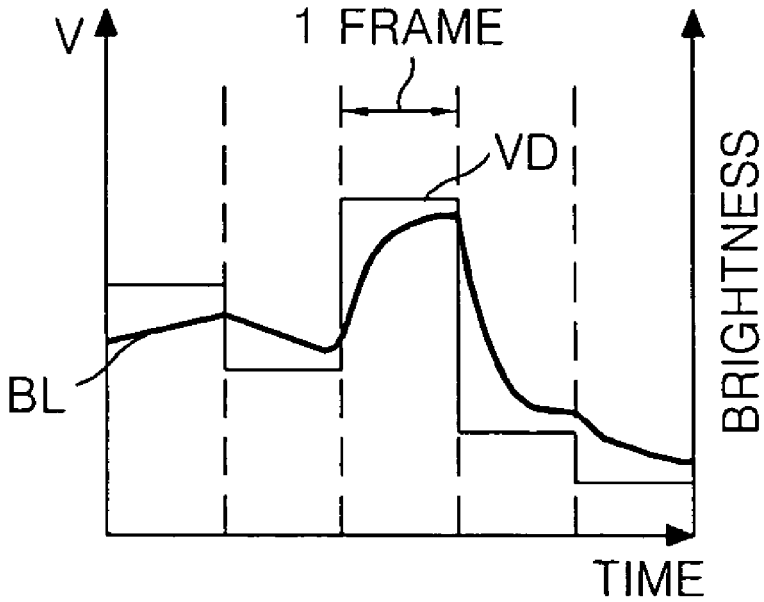
FIG. 1 RELATED ART
FIG. 1 is a waveform illustrating a change of brightness according to a data in a liquid crystal display device according to the related art.
Figure 2:
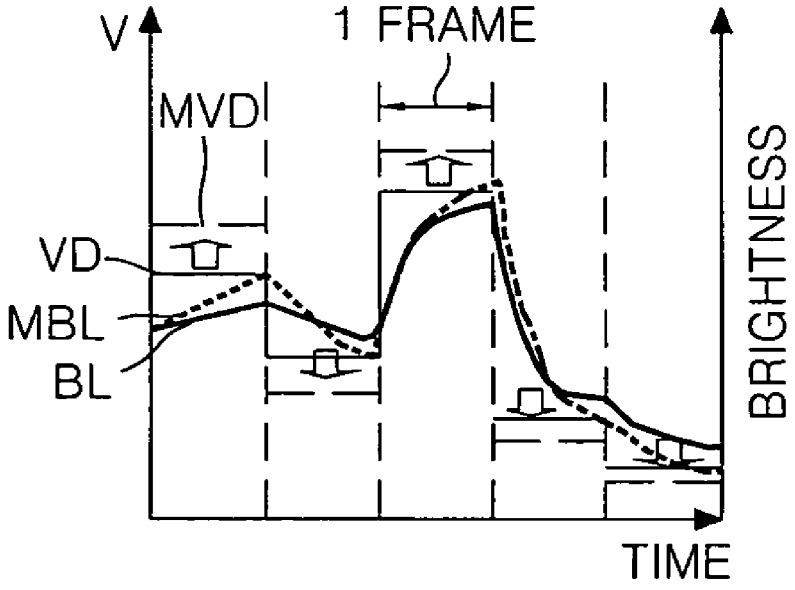
FIG. 2 RELATED ART
FIG. 2 is a waveform illustrating an example of the change of brightness according to a data modulation in a high-speed driving system according to the related art.
Figure 3:
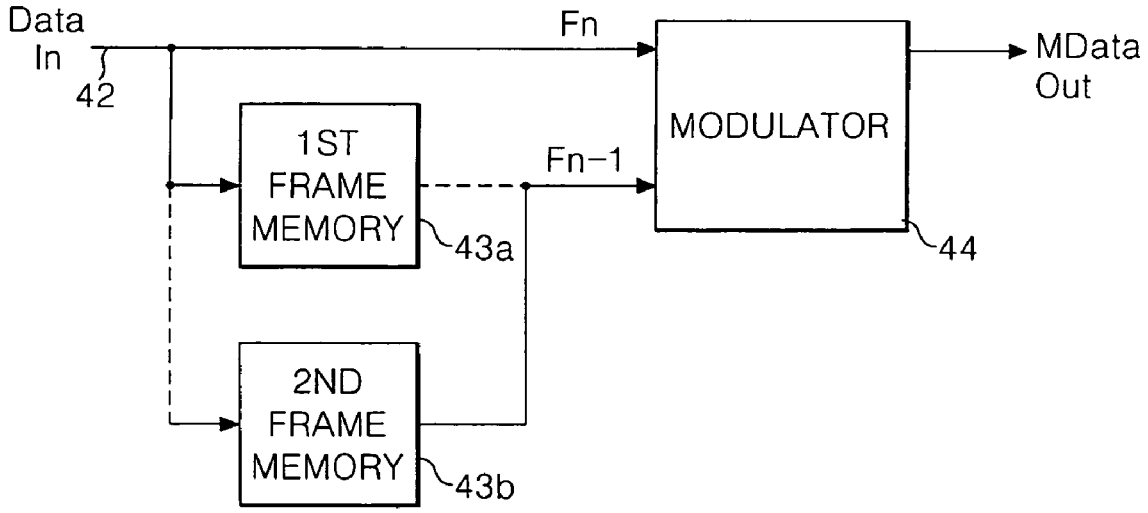
FIG. 3 RELATED ART
FIG. 3 is a block diagram illustrating an example of a high-speed driving apparatus according to the related art.
Figure 4:
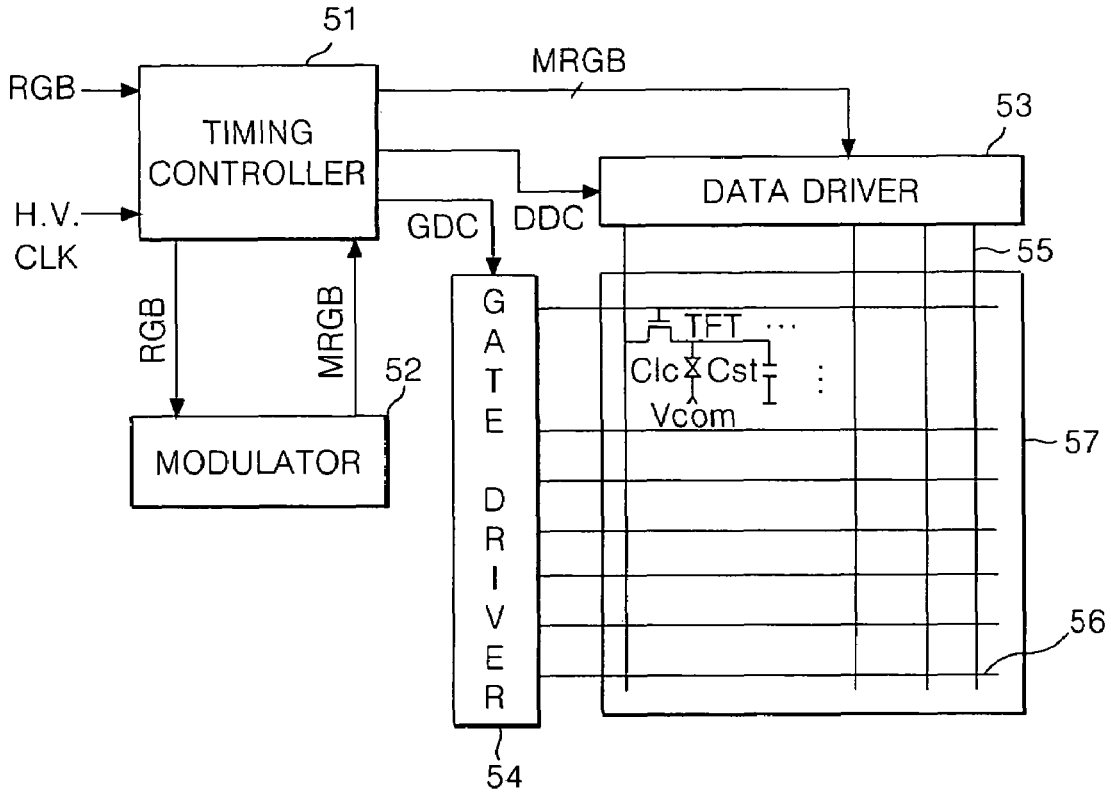
FIG. 4 is a block diagram schematically illustrating a liquid crystal display device according to an embodiment of the present invention.

FIG. 4 is a block diagram schematically illustrating a liquid crystal display device according to an embodiment of the present invention. In FIG. 4, an LCD device includes a liquid crystal display panel 57 having a plurality of liquid crystal cells Clc arranged in a matrix-like manner at intersections between data lines 55 and gate lines 56. The LCD device also includes a data driver 53 for applying data signals to the data lines 55, a gate driver 54 for applying gate signals to the gate lines 56, and a timing controller 51 for controlling the data driver 53 and the gate driver 54 using signals applied from a system (not shown).

For instance, the timing controller 51 receives vertical/horizontal synchronizing signals V and H, a clock signal CLK and data RGB from the system. The data RGB may be digital video data. In particular, the timing controller 51 samples digital video data RGB in accordance with the clock signal CLK, and supplies the sampled data RGB to a modulator 52. The modulator 52 then modulates the sampled data RGB to generate modulated data MRGB. For instance, the modulator 52 may perform a source data undergone compression and restoration processes to generate the modulated data MRGB. Then, the timing controller 51 supplies the modulated data MRGB to the data driver 53. More specifically, the timing controller 51 and the modulator 52 may be integrally formed on a single chip.

In addition, each of the liquid crystal cells Clc includes a thin film transistor TFT. The thin film transistor TFT applies a data signal from a respective one of the data lines 55 to the liquid crystal cell Clc in response to a scanning signal from a respective one of the gate lines 56. Each of the liquid crystal cells Clc also includes a storage capacitor Cst. The storage capacitor Cst maintains a voltage of the liquid crystal cell Clc.

Further, the data driver 53 receives the modulated data MRGB from the timing controller 51 and converts the modulated data MRGB into analog gamma voltages, i.e., data signals, corresponding to gray level values in response to a data control signal DDC from the timing controller 51, and applies the analog gamma voltages to the data lines 55. The gate driver 54 sequentially applies a scanning pulse to the gate lines 56 in response to a gate control signal GDC from the timing controller 51, to thereby select horizontal lines of the liquid crystal display panel 57 to be supplied with the data signals.

Although not shown, the liquid crystal display panel 57 includes a liquid crystal material injected between two glass substrates, and the data lines 55 and the gate lines 56 are formed on the lower glass substrate. The thin film transistors TFT supply data from the data lines 55 to the liquid crystal cells Clc in response to the scanning pulses from the gate lines 56. For instance, a gate electrode of the TFT is connected to each of the gate lines 56, and a source electrode thereof is connected to each of the data lines 55. In addition, a drain electrode of the TFT is connected to a pixel electrode of each liquid crystal cell Clc. Also, the storage capacitor Cst is provided on the lower glass substrate of the liquid crystal display panel 57 to keep a voltage of the liquid crystal cell Clc. The storage capacitor Cst may be provided between the liquid crystal cell Clc and a pre-stage gate line 56, or may be provided between the liquid crystal cell Clc and a separate common line.

Moreover, the modulator 52 may modulate digital video data RGB from the timing controller 51 in accordance with Formulas 3 to 5 based on a data value change between the previous frame and the current frame, and supplies the modulated data MRGB to the timing controller 51. The modulated data MRGB may be registered in a look-up table stored in the ROM, for example, an electrically erasable and programmable ROM (EEPROM).

$$Fn(RGB)<Fn-1(RGB)\text{-->}Fn(MRGB)<Fn(RGB) \quad \text{Formula 3}$$

$$Fn(RGB)=Fn-1(RGB)\text{-->}Fn(MRGB)=Fn(RGB) \quad \text{Formula 4}$$

$$Fn(RGB)>Fn-1(RGB)\text{-->}Fn(MRGB)>Fn(RGB) \quad \text{Formula 5}$$

Thus, if a pixel data value of the current frame Fn becomes larger than that of the previous frame Fn−1 at the same pixel, then the modulated data MRGB has a larger value than the pixel data at the current frame Fn. On the other hand, if a pixel data value of the current frame Fn becomes smaller than that of the previous frame Fn−1, then the modulated data MRGB has a smaller value than the pixel data at the current frame Fn. Furthermore, if a pixel data value of the current frame Fn is equal to that of the previous frame Fn−1 at the same pixel, then the modulated data MRGB is set to have the same value as the pixel data at the current frame Fn.

Although not shown, the data driver 53 may include a shift register, a register for temporarily storing the modulated data MRGB from the timing controller 51, a latch for storing a data for each one line in response to a clock signal from the shift register and for simultaneously outputting the stored data for each one line, a digital to analog converter for selecting gamma compensating voltages of positive/negative polarities in response to a digital data value from the latch, a multiplexer for selecting the data line 55 supplied with the positive/negative gamma compensating voltages, and an output buffer connected between the multiplexer and the data line 55. The data driver 53 receives the modulated data MRGB from the timing controller 51 and supplies the modulated data MRGB to the data lines 55 of the liquid crystal display panel 57 under control of the timing controller 51.

Similarly, although not shown, the gate driver 54 may include a shift register for sequentially generating scanning pulses in response to the gate control signal GDC from the timing controller 51, a level shifter for shifting a swing width of the scanning pulse into a level suitable for driving the liquid crystal cell Clc, and an output buffer. The gate driver 54 supplies the scanning pulse to the gate line 56 to turn on the thin film transistors TFT connected to the gate line 56, thereby selecting the liquid crystal cells Clc for one horizontal line to be supplied with a pixel voltage of the data, that is, the analog gamma compensating voltage. The data generated from the data driver 53 is synchronized with the scanning pulse to be supplied to the selected liquid crystal cells Clc for one horizontal line.

Figure 5:
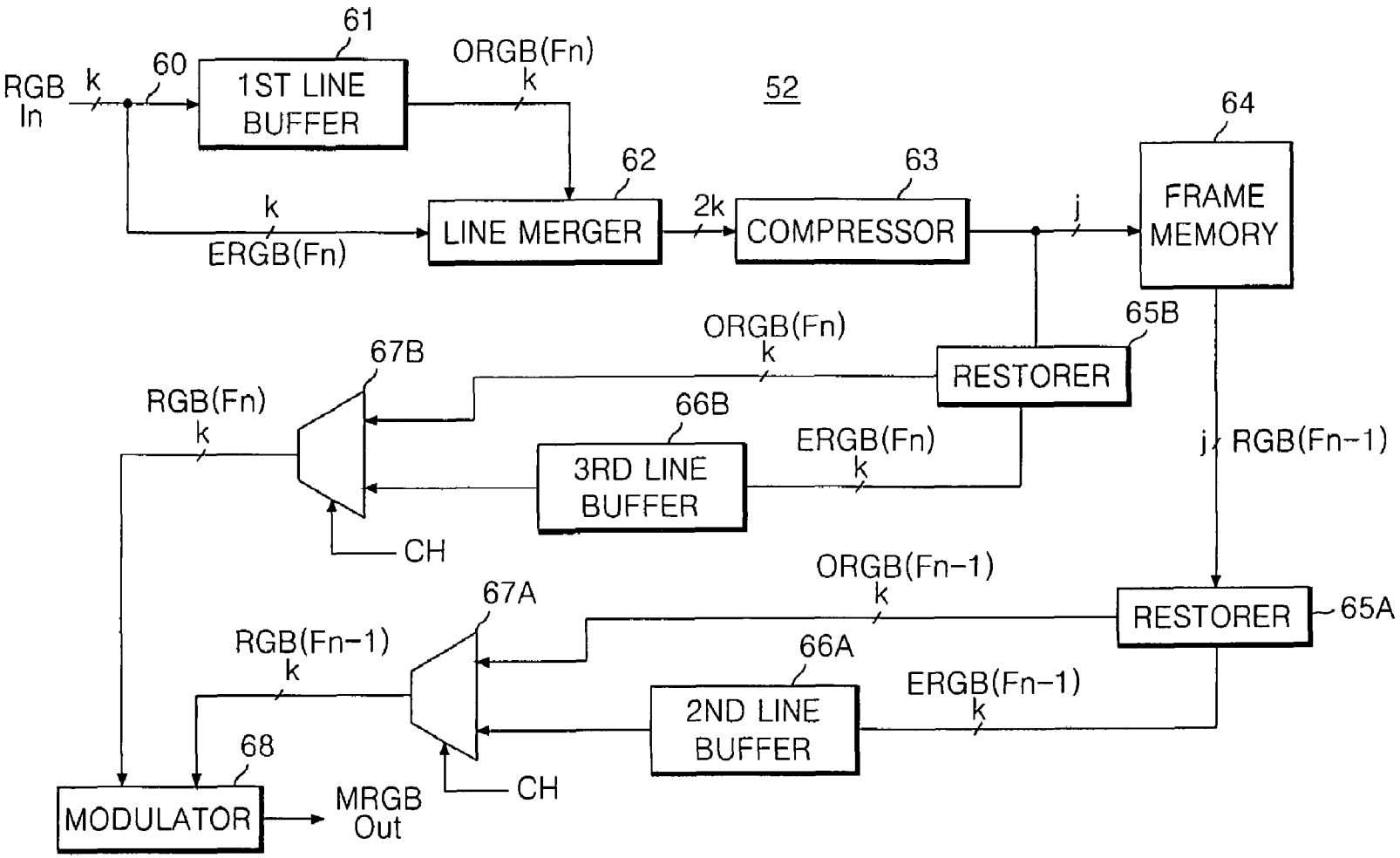
FIG. 5 is a detailed block diagram schematically illustrating the modulator shown in FIG. 4 according to an embodiment of the present invention.

FIG. 5 is a detailed block diagram schematically illustrating the modulator shown in FIG. 4 according to an embodiment of the present invention. As shown in FIG. 5, the data modulator 52 includes first to third line buffers 61, 66A and 66B, a line merger 62, a compressor 63, a frame memory 64, first and second restorers 65A and 65B, first and second multiplexers 67A and 67B and a modulator 68. The first line buffer 61 delays k-bit digital video data RGB supplied via a k-bit data input bus 60 by one line interval and thereafter applies them to the line merger 62.

The line merger 62 merges odd-line data ORGB(Fn) from the first line buffer 61 with even-line data ERGB(Fn) from the data input bus 60 on a basis of pixel to pixel, and simultaneously outputs two line data, that is, one odd-line data ORGB(Fn) and the next even-line data ERGB(Fn) by way of a 2k-bit data output bus during the even-line interval.

The compressor 63 compresses 2k-bit two-line data supplied from the line merger 62 into j-bit data, j being an integer smaller than 2k, and supplies them to the frame memory 64 and the second restorer 65B. The frame memory 64 has a j-bit data input bus and a j-bit data output bus. For instance, if the frame memory 64 is a synchronous dynamic random access memory (SDRAM), k may be 21 and j may be 32. Thus, two-line compressed data compressed by the compressor 63 is written into the frame memory 64, via the j-bit data input bus, every odd-line interval. Then, the frame memory 64 supplies two-line compressed data RGB(Fn−1) at the previous frame stored for each odd-line interval, via the j-bit data output bus, to the first restorer 65A.

The first restorer 65A restores two-line compressed data RGB(Fn−1) at the previous frame supplied from the frame memory 64, and supplies even-line restored data ERGB(Fn−1) at the previous frame, via a first k-bit data output bus, to the second line buffer 66A. The first restorer 65A supplies odd-line restored data ORGB(Fn−1) at the previous frame, via a second k-bit data output bus, to the first multiplexer 67A.

The second line buffer 66A delays the even-line restored data ERGB(Fn−1) at the previous frame supplied from the first restorer 65A by one line interval and thereafter supplies them to the first multiplexer 67A.

The first multiplexer 67A selects the odd-line restored data ORGB(Fn−1) at the previous frame supplied from the first restorer 65A for each odd-line interval while selecting the even-line restored data ERGB(Fn−1) at the previous frame supplied from the second line buffer 66A for each even-line interval in response to a control signal CH from the timing controller 51. Thus, the first multiplexer 67 supplies the odd-line restored data ORGB(Fn−1) at the previous frame to the modulator 68 in the odd-line interval and then supplies the even-line restored data ERGB(Fn−1) at the previous frame to the modulator 68 in the even-line interval in response to the control signal CH from the timing controller 51.

In addition, the second restorer 65B restores the two-line compressed data RGB(Fn) at the current frame supplied from the compressor 63, and supplies even-line restored data ERGB(Fn) at the current frame, via a third k-bit data output bus, to the third line buffer 66B. Further, the second restorer 65B supplies odd-line restored data ORGB(Fn) at the current frame, via a fourth k-bit data output bus, to the second multiplexer 67B.

The third line buffer 66B delays the even-line restored data ERGB(Fn) at the current frame supplied from the second restorer 65B by one line interval and thereafter supplies them to the second multiplexer 67B.

The second multiplexer 67B selects the odd-line restored data ORGB(Fn) at the current frame supplied from the second restorer 65B for each odd-line interval while selecting the even-line restored data ERGB(Fn) at the current frame supplied from the third line buffer 66B for each even-line interval in response to the control signal CH from the timing controller 51. Thus, the second multiplexer 67B supplies the odd-line restored data ORGB(Fn) at the current frame to the modulator 68 in the odd-line interval and then supplies the even-line restored data ERGB(Fn) at the current frame to the modulator 68 in the even-line interval in response to the control signal CH from the timing controller 51.

Moreover, the modulator 68 compares a current frame data RGB(Fn) from the second multiplexer 67B with a previous frame data RGB(Fn−1) from the first multiplexer 67A. Based on the comparison result, the modulator 68 selects the modulated data MRGB satisfying the above Formulas 3 to 5 from a look-up table. In particular, any known data compression/restoration algorithms are applicable to the data compression method performed by the compressor 63 and the data restoration method performed by the first and second restorers 65A and 65B.

Figure 6:
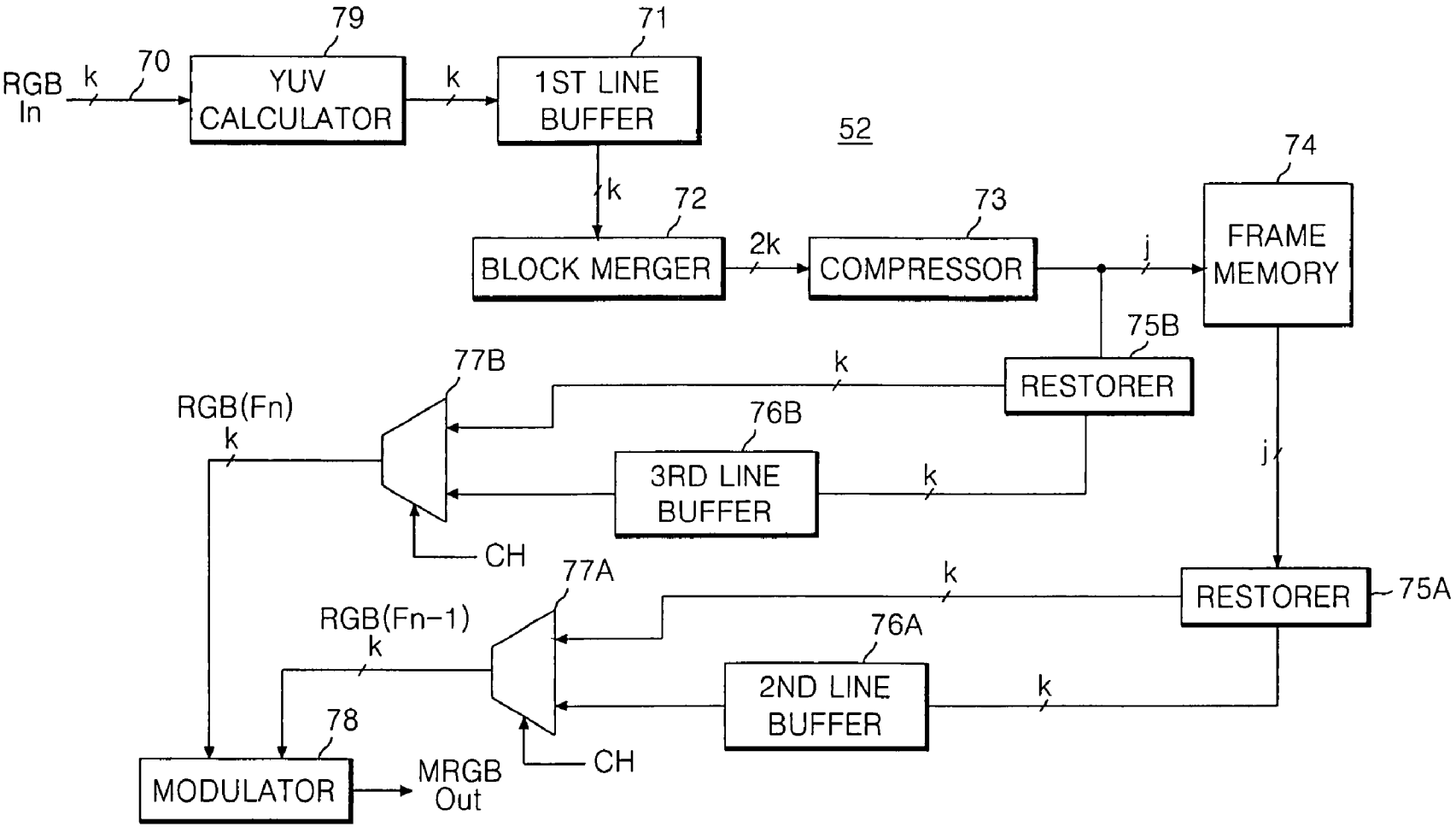
FIG. 6 is a detailed block diagram schematically illustrating the modulator shown in FIG. 4 according to another embodiment of the present invention.

FIG. 6 is a detailed block diagram schematically illustrating the modulator shown in FIG. 4 according to another embodiment of the present invention, and FIG. 7 depicts an example of 4×2 data blocks outputted from the YUV calculator shown in FIG. 6. As shown in FIG. 6, the data modulator 52 includes a YUV calculator 79, first to third line buffers 71, 76A and 76B, a block merger 72, a compressor 73, a frame memory 74, first and second restorers 75A and 75B, first and second multiplexers 77A and 77B, and a modulator 78.

The YUV calculator 79 calculates brightness information Y and chrominance information U and V of a k-bit digital video data RGB supplied via a k-bit data input bus 70. For instance, the YUV calculator 79 may calculate the brightness information Y and the chrominance information U and V based on Formulas 6 to 8. Then, the YUV calculator 79 supplies the brightness and chrominance data YUV to the first line buffer 71.

$$Y=0.229R+0.587G+0.114B \quad \text{Formula 6}$$

$$U=0.417R-0.289G+0.436B=0.492(B-Y) \quad \text{Formula 7}$$

$$V=0.615R-0.515G-0.100B=0.877(R-Y) \quad \text{Formula 8}$$

In particular, R represents a red data value; G does a green data value; and B does a blue data value.

The first line buffer 71 delays the brightness/chrominance data YUV from the YUV calculator 79 by one line interval and thereafter supplies them to the block merger 72. In addition, the block merger 72 merges odd-line brightness/chrominance data YUV from the first line buffer 71 and even-line brightness/chrominance data YUV from the YUV calculator 79. For instance, the block merger 72 may merge the odd-line and even-line brightness/chrominance data YUV into 4×2 blocks including 8 pixel data, as shown in FIG. 7, and outputs the 4×2 data blocks during the even-line interval.

The compressor 73 calculates a mean value and a variance value for each of the brightness Y and the chrominance U and V from the 4×2 data blocks at the current frame supplied from the block merger 72 and thereafter replaces pixel data more than the mean value by '1' while replacing pixel data less than the mean value by '0', thereby compressing the data.

FIG. 8 and FIG. 9 are views for explaining an compression principle of the compressor shown in FIG. 6. As shown in FIG. 8, pixel data more than the mean value is 'A' and pixel data less than the mean value is 'B'. In particular, a value of 'A' may correspond to Formula 9 and a value of 'B' may correspond to Formula 10.

$$f_M + f_V\sqrt{\frac{L}{N-L}} \quad \text{Formula 9}$$

$$f_M - f_V\sqrt{\frac{L}{N-L}} \quad \text{Formula 10}$$

In the above Formulas 9 and 10, $f_M$ represents a mean value for 8 pixel data included in the 4×2 data blocks, and $f_V$ represents a variance value between 8 pixel data included in the 4×2 data blocks. Further, L represents the number of pixels larger than or equal to $f_M$ (4 replaced by A in the example of FIG. 8), and N represents total number of pixels (i.e., 8).

If A is replaced by '1' and B is replaced by '0', as shown in FIG. 9, the compressed data includes 3[byte] consisting of 1 [byte] of the A value, 1 [byte] of the B value and 1 [byte] of the AB divided value. In particular, the AB divided value is '11011000'. The 8[byte] data of the 4×2 data blocks as shown in FIG. 7 is compressed into 3[byte] data as shown in FIG. 9 by means of the compressor 73.

The first restorer 75A restores the data from the frame memory 74 into the brightness/chrominance data as shown in FIG. 7 with the aid of a restoration algorithm corresponding to a compression algorithm of the compressor 73, and then restores the digital video data RGB based on Formulas 11 to 13.

$$R=Y+1.14V \quad \text{Formula 11}$$

$$G=Y-0.395U-0.581V \quad \text{Formula 12}$$

$$B=Y+2.032U \quad \text{Formula 13}$$

Further, the first restorer 75A supplies even-line restored data at the previous frame, via a first k-bit data output bus, to the second line buffer 76A, and supplies odd-line restored data at the previous frame, via a second k-bit data output bus, to the first multiplexer 77A.

The second line buffer 76A delays even-line restored data at the previous frame supplied from the first restorer 75A by one line interval and thereafter supplies them to the first multiplexer 77A.

The first multiplexer 77A selects the odd-line restored data at the previous frame supplied from the first restorer 75A for each odd-line interval while selecting the even-line restored data at the previous frame supplied from the second line buffer 76A for each even-line interval in response to a control signal CH from the timing controller 51. Thus, the first multiplexer 77A supplies the odd-line restored data at the previous frame to the modulator 78 in the odd-line interval and then supplies the even-line restored data at the previous frame to the modulator 78 in the even-line interval in response to the control signal CH from the timing controller 51.

The second restorer 75B restores a current frame data from the compressor 73 with the aid of a restoration algorithm corresponding to a compression algorithm of the compressor 73. Further, the second restorer 75B supplies even-line restored data at the current frame, via a third first k-bit data output bus, to the third line buffer 76B while supplying even-line restored data at the current frame, via a fourth k-bit data output bus, to the second multiplexer 77B.

The third line buffer 76B delays even-line restored data at the current frame supplied from the second restorer 75B by one line interval and thereafter supplies them to the second multiplexer 77B.

The second multiplexer 77B selects the odd-line restored data at the current frame supplied from the second restorer 75B for each odd-line interval while selecting the even-line restored data at the current frame supplied from the third line buffer 76B for each even-line interval in response to the control signal CH from the timing controller 51. Thus, the second multiplexer 77B supplies the odd-line restored data at the current frame to the modulator 78 in the odd-line interval and then supplies the even-line restored data at the current frame to the modulator 78 in the even-line interval in response to the control signal CH from the timing controller 51.

The modulator 78 compares a current frame data RGB(Fn) from the second multiplexer 77B with a previous frame data RGB(Fn−1) from the first multiplexer 77A. Based on the comparison result, the modulator 68 selects the modulated data MRGB satisfying the above Formulas 3 to 5 from a look-up table.

Alternatively, the method and apparatus of driving the liquid crystal display device according to an embodiment of the present invention may modulate only most significant bits (MSB) in the digital video data. Thus, the number of the frame memories 64 and 74 and a memory capacity of the modulators 68 and 78 can be reduced.

As described above, according to an embodiment of the present invention, the compressed data is stored in the frame memory and then the data read from the frame memory is restored. As a result, a fast response speed of the liquid crystal material can be not only obtained to improve a display quality, but also the number of frame memories can be reduced to lower a fabrication cost.

It will be apparent to those skilled in the art that various modifications and variations can be made in the method and the apparatus for driving a liquid crystal display device of the present invention without departing from the sprit or scope of the invention. Thus, it is intended that the present invention covers the modifications and variations of this invention provided they come within the scope of the appended claims and their equivalents.

What is claimed is:

1. A method of driving a liquid crystal display device comprising:

delaying odd-line data of a current frame data by one line interval;

merging the delayed odd-line data of the current frame data with non-delayed even-line data of the current frame data to simultaneously output the odd-line data and the even-line data of the current frame data compressing the merged odd-line data and the even-line data of the current frame;

storing the compressed current frame data in a frame memory;

outputting a compressed data of a previous frame from the frame memory;

restoring the compressed data of the previous frame;

delaying even-line restored data of the restored data of the previous frame by one line interval;

selecting the delayed even-line restored data and non-delayed odd-line restored data of the previous frame alternately for each one line interval;

restoring the compressed current frame data while storing the compressed current frame data to the frame memory;

delaying even-line restored data of the restored data of the current frame by one line interval;

selecting the delayed even-line restored data and non-delayed odd-line restored of the current frame data alternately for each one line interval; and comparing the restored data of the previous frame with the restored data of the current frame; and modulating the current frame data into a predetermined modulated data based on the comparison result.

2. A method of driving a liquid crystal display device comprising:

calculating brightness and chrominance for each pixel data of a current frame data;

making a block of a plurality of pixel data including the brightness and chrominance; and calculating a mean value of the block and a difference value between the plurality of pixel data included in the block and compressing the current frame data;

storing the compressed current frame data in a frame memory;

outputting a compressed data of a previous frame from the frame memory;

restoring the compressed data of the previous frame;

comparing the restored data of the previous frame with the current frame data; and modulating the current frame data into a predetermined modulated data based on the comparison result.

3. The method of claim 2, wherein the step of compressing the current frame data includes:

replacing the pixel data more than the mean value by '1' while replacing the pixel data less than the mean value by '0', thereby compressing the current frame data.

4. A method of driving a liquid crystal display device comprising the steps of:

delaying odd-line data of a current frame data by one line interval:

merging the delayed odd-line data with non-delayed even-line data and simultaneously supplying the odd-line data and the even-line data to a 2k-bit data input bus compressing the merged odd-line data and the even-line data of the current frame inputted via the 2k-bit data input bus into j-bit data, k being an integer and j being an integer smaller than 2k;

storing the j-bit compressed current frame data in a frame memory via a j-bit data input bus;

outputting a compressed data having been stored in the frame memory at a previous frame via a j-bit data output bus;

restoring the compressed data of the previous frame to output them via a 2k-bit data output bus;

delaying even-line restored data of the restored data of the previous frame by one line interval;

selecting the delayed even-line restored data and non-delayed odd-line restored data of the previous frame alternately for each one line interval;

restoring the compressed current frame data while storing the compressed current frame data to the frame memory;

delaying even-line restored data of the restored data of the current frame by one line interval;

selecting the delayed even-line restored data and non-delayed odd-line restored of the current frame data alternately for each one line interval;

comparing the restored data of the previous frame inputted via the 2k-bit data output bus with the restored data of the current frame inputted via the 2k-bit data input bus; and modulating the current frame data into a predetermined modulated data based on the comparison result.

5. A method of driving a liquid crystal display device comprising the steps of:

calculating brightness and chrominance for each pixel data of a current frame data;

forming a 2k-bit block of a plurality of pixel data including the brightness and chrominance; and supplying the 2k-bit block to a 2k-bit data input bus compressing the current frame data inputted via the 2k-bit data input bus into j-bit data, k being an integer and j being an integer smaller than 2k;

storing the j-bit compressed current frame data in a frame memory via a j-bit data input bus;

outputting a compressed data having been stored in the frame memory at a previous frame via a j-bit data output bus;

restoring the compressed data of the previous frame to output them via a 2k-bit data output bus;

comparing the restored data of the previous frame inputted via the 2k-bit data output bus with the current frame data inputted via the 2k-bit data input bus; and modulating the current frame data into a predetermined modulated data based on the comparison result.

6. A driving apparatus for a liquid crystal display device, comprising:

a first delay for delaying odd-line data of a current frame data by one line interval;

a merger for merging the delayed odd-line data of the current frame data with non-delayed even-line data of the current frame data to simultaneously apply the odd-line data and the even-line data of the current frame data to the compressor;

a compressor for compressing the current frame data from the merger;

a frame memory for storing the compressed current frame data and outputting a compressed data having been stored at a previous frame;

a first restorer for restoring the compressed data of the previous frame;

a second delay for delaying even-line data of the restored data of the previous frame restored by the first restorer by one line interval;

a first multiplexer for selecting the even-line restored data delayed by the second delay and the non-delayed odd-line restored data of the previous frame alternately for each one line interval;

a second restorer for restoring the compressed data at the current frame; and a third delay for delaying the even-line data of the restored data of the current frame restored by the second restorer by one line interval; and a second multiplexer for selecting the even-line restored data delayed by the third delay and the non-delayed odd-line restored data of the current frame alternately for each one line interval;

a modulator for comparing the restored data of the previous frame from the first multiplexer with the restored data of current frame from the second multiplexer and for modulating the current frame data into a predetermined modulated data based on the comparison result.

7. A driving apparatus for a liquid crystal display device, comprising:

a brightness and chrominance calculator for calculating brightness and chrominance for each pixel data from the current frame data;

a block merger for making a block of a plurality of pixel data including the brightness and chrominance;

a compressor for compressing the current frame data from the block merger;

a frame memory for storing the compressed current frame data and outputting a compressed data having been stored at a previous frame;

a restorer for restoring the compressed data of the previous frame;

a modulator for comparing the restored data of the previous frame with the current frame data for modulating the current frame data into a predetermined modulated data based on the comparison result.

8. The driving apparatus of claim 7, wherein the compressor calculates a mean value of the block and a difference value between the plurality pixel data included in the block to replace the pixel data being more than the mean value with '1' and to replace the pixel data being less than the mean value with '0', thereby compressing the current frame data.

9. A driving apparatus for a liquid crystal display device, comprising:

a first delay for delaying odd-line data of a current frame data by one line interval;

a merger for merging the delayed odd-line data of the current frame with non-delayed even-line data of the current frame to simultaneously apply the odd-line data and the even-line data;

a compressor for compressing the current frame data inputted via a 2k-bit data input bus from the merger into j-bit data, k being an integer and j being an integer smaller than 2k;

a frame memory for receiving the j-bit compressed current frame data via a j-bit data input bus to store them and for outputting a compressed data having been stored at the previous frame via a j-bit data output bus;

a first restorer for restoring the compressed data of the previous frame to output them via a 2k-bit data output bus;

a second delay for delaying the even-line data of the restored data of the previous frame restored by the fist restorer by one line interval;

a first multiplexer for selecting the even-line restored data delayed by the second delay and the non-delayed odd-line restored data of the previous frame alternately for each one line interval;

a second restorer for restoring the compressed data of the current frame;

a third delay for delaying the even-line data of the restored data of the current frame restored by the second restorer by one line interval;

a second multiplexer for selecting the even-line restored data delayed by the third delay and the non-delayed odd-line restored data from the second restorer alternately for each one line interval; and a modulator for comparing the restored data of the previous frame inputted via the 2k-bit data output bus from the first multiplexer with the restored data of the current frame inputted via the 2k-bit data input bus from the second multiplexer and for modulating the current frame data into a predetermined modulated data based on the comparison result.

10. The driving apparatus of claim 9, further comprising:

a brightness and chrominance calculator for calculating brightness and chrominance for each pixel data of a current frame data;

a block merger for making a block of a plurality of pixel data including the brightness and chrominance and for applying the block to the compressor;

a compressor for compressing the current frame data inputted via a 2k-bit data input bus from the block merger into j-bit data, k being an integer and j being an integer smaller than 2k;

a frame memory for receiving the j-bit compressed current frame data via a j-bit data input bus to store them and for outputting a compressed data having been stored at the previous frame via a j-bit data output bus;

a restorer for restoring the compressed data of the previous frame to output them via a 2k-bit data output bus;

a modulator for comparing the restored data of the previous frame inputted via the 2k-bit data output bus with the current frame data inputted via the 2k-bit data input bus and for modulating the current frame data into a predetermined modulated data based on the comparison result.

11. The driving apparatus of claim 10, wherein the compressor calculates a mean value of the block and a difference value between the plurality pixel data included in the block to replace the pixel data being more than the mean value with '1' and to replace the pixel data being less than the mean value with '0', thereby compressing the current frame data.

* * * * *